US005249769A

United States Patent [19]

Griek et al.

[11] Patent Number: 5,249,769

[45] Date of Patent: Oct. 5, 1993

[54] CLAMP FOR BUILDING STRUCTURES

[76] Inventors: Cornelius J. Griek, 6 Mervyn Road, Belgrave South, Victoria, 3160; Anthony K. Mitchinson, 27 Wandena Crescent, Mooroolbark, Victoria, 3138, both of Australia

[21] Appl. No.: 582,863

[22] PCT Filed: Apr. 7, 1989

[86] PCT No.: PCT/AU89/00155

§ 371 Date: Oct. 10, 1990

§ 102(e) Date: Oct. 10, 1990

[87] PCT Pub. No.: WO89/09863

PCT Pub. Date: Oct. 19, 1989

[30] Foreign Application Priority Data

| | | | |
|---|---|---|---|
| Apr. 8, 1988 | [AU] | Australia | PI7644/88 |
| May 2, 1988 | [AU] | Australia | PI8009/88 |
| Jun. 27, 1988 | [AU] | Australia | PI8995/88 |
| Feb. 15, 1989 | [AU] | Australia | PJ2749/89 |

[51] Int. Cl.[5] ..... F16B 1/00

[52] U.S. Cl. ..... 248/225.31; 182/113; 256/1; 256/65

[58] Field of Search ..... 248/237, 231.7, 225.31; 52/DIG. 12; 182/45, 113; 256/DIG. 6, 65, 1

[56] References Cited

U.S. PATENT DOCUMENTS

| | | | |
|---|---|---|---|
| 296,037 | 4/1884 | Moll et al. | 182/113 X |
| 1,655,444 | 1/1928 | Tiritter | 248/225.31 |
| 2,557,147 | 6/1951 | Schatzman | 248/231.7 X |
| 2,999,290 | 9/1961 | Giles . | |
| 3,084,759 | 4/1963 | Squire . | |
| 3,124,330 | 3/1964 | Robinson . | |
| 3,164,353 | 1/1965 | Rene . | |
| 3,480,257 | 11/1969 | Bowen et al. | 182/113 X |
| 3,526,296 | 9/1970 | Stevens . | |
| 3,584,839 | 6/1971 | Dickey | 256/65 X |
| 3,747,898 | 7/1973 | Warren | 256/65 X |
| 3,863,899 | 2/1975 | Werner | 182/113 X |
| 3,880,405 | 4/1975 | Brueske | 248/237 |
| 3,901,481 | 8/1975 | Probst | 248/237 X |
| 3,938,619 | 2/1976 | Kurabagashi et al. | 182/113 |
| 4,334,662 | 6/1982 | Davis et al. . | |
| 5,029,670 | 7/1991 | Whitmer | 182/113 |

FOREIGN PATENT DOCUMENTS

| | | |
|---|---|---|
| 841894 | 4/1952 | Fed. Rep. of Germany . |
| 3432687 | 4/1985 | Fed. Rep. of Germany . |
| 857321 | 9/1940 | France . |
| 128792 | 12/1928 | Switzerland . |
| 2141777 | 1/1985 | United Kingdom . |

*Primary Examiner*—David L. Talbott
*Attorney, Agent, or Firm*—Lucas & Just

[57] ABSTRACT

The support (10) is securely clampable to a raised profile (12) of the roof decking (14) without piercing the decking and supports a safety barrier (34). Alternatively the support (10) may support a display sign or formwork locator. The support (10) comprises a clamp (24) and a support element (25) over which an upright support post (26) carrying the barrier (34) is telescopically received. The clamp (24) comprises a pair of clamping jaws (36 and 38) which are pivoted to each other and have respective feet (56) at their ends remote from the pivotal connection (44). The feet engage the deck (14) and particularly have respective projecting flanges (66) which cooperate with opposed undercuts on the raised profile (12) when the clamp (24) is tightened by a screw threaded arrangement (50, 52) remote from the pivotal connection (44). A brace (68) is provided with a clamp (84) similar to the clamp (24). The brace is rotatable about the support element (25) and the clamp (84) can be correspondingly adjusted to be clampable to the same or different profile (12) as the clamp (24).

22 Claims, 6 Drawing Sheets

CLAMP FOR BUILDING STRUCTURES

This invention relates to clamps for use in building structures and is particularly concerned with structures adapted to be carried by a building during or after completion of fabrication of the building. Most particularly the invention is concerned with a support for such structures.

During construction or maintenance operations on a building it is advantageous to erect a safety barrier near to the edge of a deck (including a roof) so that workers can be protected against falling from the deck or at least can be warned of the proximity of the edge of the deck.

At present many construction site accidents involve workers accidentally falling from the decks of buildings under construction. To overcome this problem there have been many proposals to erect a barrier around deck edges to restrain a worker or at least to clearly visually indicate to the worker the proximity of the deck edge. However, no such safety barriers have been simple to erect, secure and avoid the need to penetrate the deck.

One proposal is described in U.S. Pat. No. 3,880,405 in which a support post of the safety barrier is supported on a plate which is located over a raised deck roof profile and fastened through the decking. A problem with this arrangement is that the fastening is through a valley of the profiled deck so that water on the deck can seep through the openings for the fasteners through the deck, particularly after the safety barrier has been removed. In a proposed modification, where the deck profile has a raised seam, this may be used to secure the foot plate. For this purpose the plate is provided with a pair of opposed pointed shanks at least one of which is screwthreaded for adjustment to pinch the seam between the points. A disadvantage of this proposal is that the slightest loosening of the pinch by direct rotation of one or both shanks will release the plate from the deck. This is recognized in U.S. Pat. No. 3,880,405 and the plate may optionally be fastened through openings in the deck, with the aforementioned resultant disadvantage. It may also be difficult to sufficiently tighten the shanks.

In buildings under construction, formwork must be erected around, for example, a concrete slab to be poured. Sometimes the slab may not be completely poured in one operation so that temporary formwork needs to be erected at the position where the initially poured segment of the slab is to end. This can be difficult or inconvenient to erect, particularly during construction of multiple floor buildings where a concrete floor slab is to be poured on floor decking which is to become part of the concrete slab floor. The mounting of formwork can be inconvenient and can involve construction of locating and securing arrangements on site and this can be time consuming if special components have to be continually manufactured on site to enable erection of the formwork.

Furthermore, it is frequently necessary to temporarily or permanently mount a display sign to a building. For example, advertising signs are frequently required to be mounted to decking such as roof decking provided on top of a shop awning. Frequently erection of such a sign involves construction of a special mounting frame for each particular installation, and the fastening of such a sign to the decking usually involves penetration of the roof decking with consequent problems of sealing the points of penetration against water penetration and corrosion.

It is an object of the present invention to provide a support for a structure such as the aforementioned safety barrier, formwork or display adapted to be carried on a building which support is relatively simple to use, is secure and is usable in a variety of possible situations.

According to the present invention, there is provided a support for a structure adapted to be carried by a deck of a building during or after completion of fabrication of the building, such structure comprising a plurality of the supports, the support comprising a support element to which the structure may be mounted and clamping means comprising a pair of clamping jaws selectively movable towards each other by a clamping mechanism, each clamping jaw comprising a foot adapted to engage the deck at a respective side of a raised profile of the deck and movable with the jaw, the clamping jaws defining at least one projecting portion which is capable of engaging a recess or undercut in the raised profile of the deck or in a fitting secured over the deck profile so that operation of the clamping mechanism causes the clamping jaws to securely clamp to the deck and hold the support element against displacement.

Further according to the present invention there is provided a structure, comprising for example a safety barrier, a display assembly or a formwork assembly, having a plurality of deck-mountable supports, each said support being substantially as described in the immediately preceding paragraph.

Still further according to the present invention there is provided a structure as described in the immediately preceding paragraph wherein for each support the feet are in engagement with the deck at respective sides of the raised profile of the deck, the at least one projecting portion is engaged with the recess or undercut in the raised profile or in the fitting secured over the deck profile whereby the clamping jaws are securely clamped to the deck.

By the present invention, the support or supports may be reliably secured to a profiled structural decking without additional penetration of the decking over the normal method of fixing the decking to a timber or metal purlin.

The support includes a support element for providing a mounting for the structure. The support element may have a configuration that depends upon the particular structure or may be universal so that different structures may be secured to one configuration of the support. Preferably, where the support is to be used for a safety barrier or a display assembly it includes an upright support post which may be integral with or extend from the support element.

It is to be appreciated that the support according to the present invention may be usable in any appropriate situation in a building where a structure is to be secured temporarily or permanently to the building.

Where the support is used as part of a safety barrier, a plurality of the supports are preferably erected along a deck edge or around an opening in the deck such as a light well or stair or lift well. Preferably the supports are arranged to mount intermediate barriers between them. For example, the barriers may comprise one or more generally horizontal rails supported by and extending between adjacent supports. Alternatively or in addition, the intermediate barriers may comprise netting extending between adjacent supports and operative to visually indicate the presence of the barrier and/or restrain a worker or article against passing between adjacent supports. In the case where the intermediate barrier comprises a plurality of horizontal rails, preferably one of the rails is capable of being located relatively close to the level of the deck so that a worker or article moving towards the edge e.g. by sliding down a sloping roof deck can encounter and be restrained by the low rail, and not pass beneath the barrier.

The clamping jaws of the clamping means may be arranged relative to the support element so that if the barrier is mounted to a horizontal deck, an upright support post may incline inwardly towards the center of the deck whereby any force against the post or intermediate barriers is at least partially directed downwardly along the line of the post. Also with this arrangement, if the support is mounted on a sloping deck, the post may be more nearly vertical.

Generally, the clamping jaw associated with each support may be pivoted relative to each other at a position remote from the feet or may be otherwise relatively movable, for example, by a relative sliding action. The clamping jaws may comprise a pair of substantially straight legs each having the associated foot at one end, and said legs being arranged such that they are substantially parallel when the clamping jaws are securely clamped to the deck. The clamping jaws may include a main jaw which is fixed relative to or integral with the support element and, for example, may be generally colinear with the support element, and a secondary jaw movable towards and away from the main jaw so as to thereby clamp to or be released from the deck. The clamping mechanism may comprise, for example, a screw mechanism extending between the clamping jaws, and having a screw threaded shaft which is adjustable, for example by a handle, to relatively displace the jaws towards each other. Opposite adjustment of the shaft may merely release the clamping jaws or may positively move them away from each other. Alternatively, the clamping mechanism may comprise a camming mechanism by means of which the clamping jaws may be moved selectively towards and away from each other. For example, the camming mechanism may include an eccentrically mounted cam mounted on one jaw and having a cam follower engaging the other jaw so that movement of the cam causes relative movement of the jaws.

The feet of the clamping jaws may engage the respective sides of the raised profile of the deck (or the sides of the fitting secured over the profile) or the deck to respective sides of the profile, or both. Where the feet of the clamping jaws engage at least the profile or an associated fitting, the at least one projecting portion of the clamping jaws may form part of at least one of the feet.

In one embodiment of the clamping means, each clamping jaw has at least one projecting portion, each said projecting portion being arranged such that it is inclined upwardly towards a remote end when the clamping jaws are securely clamped to the deck. By this means, the projection portions may engage tightly in a corresponding undercut or recess. Preferably each projecting portion comprises an elongate flange adapted to extend along the raised profile of the deck. The feet generally may include elongate portions which extend along the deck profile in use so as to increase the effective length over which the clamping jaws engage the deck. Other shapes for the at least one projecting portion may be envisaged, and in another embodiment of the clamping jaws, the at least one projecting portion is formed in one of the clamping jaws and an opposed aperture is provided in the other clamping jaw. By this arrangement, the projecting portion may pass through an opening in the raised profile or fitting, or engage a preformed recess, or form the recess in one side of the raised profile and a corresponding convex formation on the opposite side of the profile may engage the opposed aperture in the other jaw.

In some decking, for example corrugated iron roof decking, the decking includes a series of inverted channels without any recesses or undercuts to which the support could be clamped. With this kind of decking the support may be usable in conjunction with a retaining fitting to be fixed to the decking, preferably at the same time as the decking is affixed to the roof structure. The fitting may, for example, include a downwardly concave formation generally complementary to the inverted channel formation of the decking, as well as outwardly extending shoulders arranged to co-operate with the clamping jaws. The shoulders for example may be defined by tabs or the like extending laterally from the concave shape. The fitting may be formed for example by pressing metal sheet into desired shape. If roofing nails or screws are used to fix the decking to the roof structure, e.g. to battens or purlins, the fitting may be located over the decking and the fixing nails or screws passed through the fitting and then through the decking to secure the fitting and decking in position. The clamping jaws can then be located in position and moved towards each other by the clamping mechanism in order to secure the support to the fitting and hence to the deck. By this means no additional holes are made through the decking.

The support may also include bracing means extending away from the support element to a spaced clamping point, the bracing means thereby further bracing the support against dislodgement. The bracing means may be provided with further clamping means comprising a pair of clamping jaws selectively movable towards each other by a clamping mechanism, each clamping jaw of the further clamping means comprising a foot adapted to engage the deck at a respective side of a raised profile of the deck and movable with the jaw, the clamping jaws of the further clamping means defining at least one projecting portion which is capable of engaging a recess or undercut in the raised profile of the deck or in a fitting secured over the deck profile so that operation of said clamping mechanism causes the clamping jaws to securely clamp to the deck and hold the bracing means against displacement.

The further clamping means may include any of the described features of the first mentioned clamping means and is most preferably substantially identical to the latter.

Preferably the bracing means comprises an outrigger arm extending from the support element and the further clamping means is slidably received on the outrigger arm, with locking means being provided to selectively secure the further clamping means against said sliding movement. The bracing means may be buttressed to the support element, so that if for example the aforementioned outrigger arm extends substantially horizontally away from a lower portion of an upright support element, a buttressing arm may extend in inclined manner away from an upper portion of the support element downwardly to the outrigger arm at least part way along from the support element. Alternatively, the portion of the outrigger arm which extends from the connection with the buttressing arm towards the lower portion of the support element may be omitted.

Preferably the bracing means has a swivel connection to the support element so that the bracing means can be rotated about the support element, e.g. so as to extend parallel to a decking profile or at right angles to a decking profile. This enables the bracing means to be used, for example, with one of a series of the supports arranged along a generally horizontal lower edge of a roof deck or arranged along a sloping edge leading up to the ridge line of a gable roof, with the bracing means optionally extending inwardly or outwardly relative to the roof edge.

The clamping jaws on the bracing means may advantageously be capable of being mounted at variable angles relative to the principal axis of the bracing means. That is, the clamping jaws may be movable towards and away from each other in the general direction of the principal axis of the bracing means or, in another position, may be movable towards and away from each other, for example, transverse to said axis. This enables the bracing means to be clamped to the deck whether it extends parallel or transverse to the deck.

In one possible embodiment using the aforementioned outrigger arm, the further clamping means may carry a pair of slide members each capable of being received on the outrigger arm, said slide members having slide axes at right angles to each other.

Where the support is for use with floor decking on which concrete is to be poured to form a slab floor of the structure, the clamping jaw or jaws may include detachable feet adapted to be left in site in the concrete slab. When the concrete is poured and the support is removed, if necessary the feet can be cut off level with the slab surface.

Where the support is adapted to carry a formwork assembly for a structural deck on to which concrete is to be poured, the support element may comprise slide means for providing a connection for a formwork locator, that is locating means for a formwork board. The slide means may comprise a pair of slide members each capable of slidably engaging a locating arm of the locating means, the slide members having slide axes at right angles to each other. The purpose of this is that the formwork locator may readily support the formwork board parallel to or transverse to the deck profile. The clamping means and slide means may be identical to the further clamping means and slide members of the aforementioned optional bracing means used with, for example, the safety barrier or display assembly.

The locating arm preferably extends generally horizontally from the slide means and may be secured in place by appropriate locking screws. A bracket may depend from the remote end of the locating arm against which the formwork board may abut or be supported.

A display assembly may be carried by two or more of the supports particularly on, for example, a shop roof or awning where the roof or awning comprises decking. The display assembly support will generally include an upright support post and the display assembly may conveniently include a mounting sleeve adapted to be telescopically received by the support post. The mounting sleeve may be provided with one or more mounting brackets on its outer surface which may each comprise a shank portion extending outwardly from the sleeve, and an enlarged head at the remote end of the shank. This construction of mounting bracket may enable a supporting channel on the rear of the display sign to slidably receive the enlarged head of the bracket.

The mounting sleeve is preferably rotatable relative to the support post about its longitudinal axis so that the mounting brackets and hence the display sign may be arranged to face generally in any desired direction. For example a sign mounted on top of a shop awning by a single support may be angled at 45° to the general line of the decking profile. The angular position of the mounting sleeve may be locked by means of a clamping screw passing through the sleeve and in use bearing against the outer surface of the support post.

Various embodiments of a support in accordance with the present invention will now be described by way of example only with reference to the accompanying drawings, in which.

Figure 1:
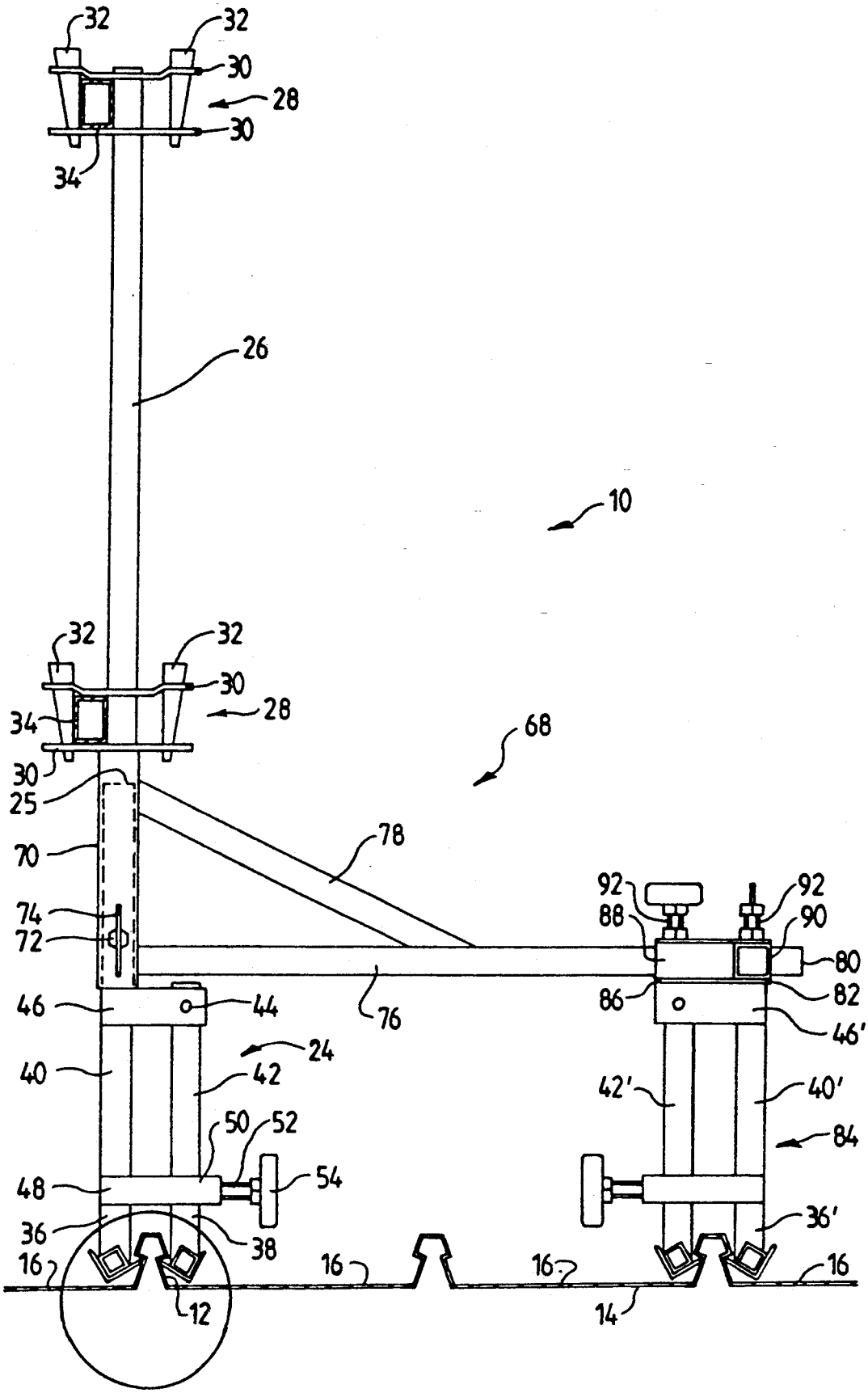
FIG. 1 is a side elevational view of a safety barrier incorporating a first embodiment of the support clamped to one type of deck profile.
Figure 2:
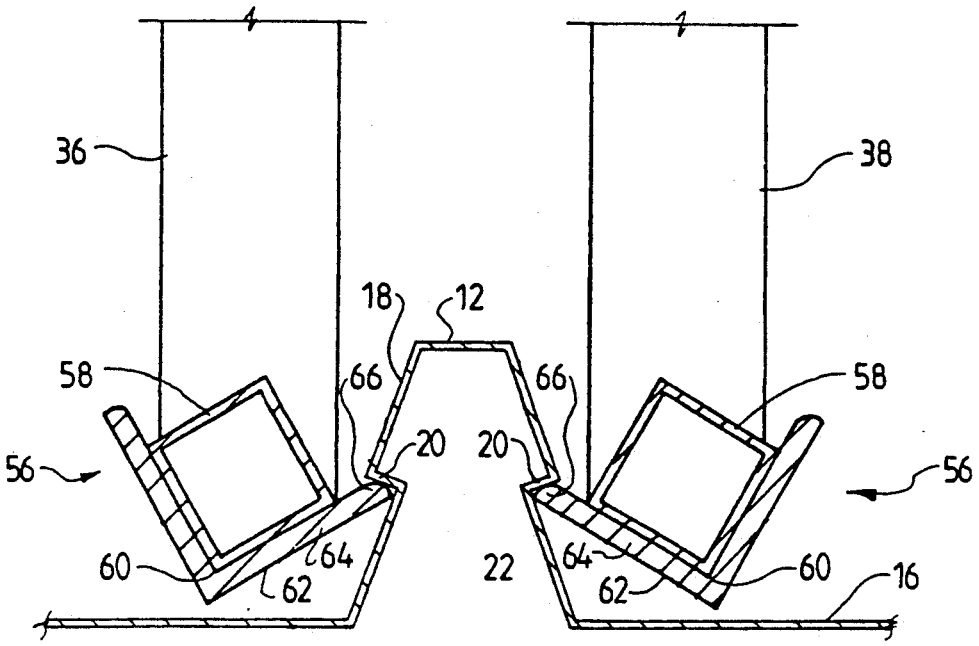
FIG. 2 is an enlarged detail of the circled portion of FIG. 1, partly in section.

FIGS. 1 and 2 illustrate a first embodiment of safety barrier support 10 releasably secured to a raised profile 12 of decking 14 shown in greater detail in FIG. 2. The support 10 is clamped to the decking 14 without puncturing the decking go that the likelihood of water leaks through the decking is reduced. The safety barrier may extend around an edge of the deck or around an opening in the deck to prevent personnel, or in some cases objects, passing beyond the barrier or at least to warn personnel of danger on the other side of the barrier.

The decking 14 illustrated in FIGS. 1 and 2 may extend horizontally or be inclined, and has a series of flat valleys 16 separated by the raised profiles 12. In this case the profiles 12 have an inverted channel section of generally tapering section and including an enlarged head 18. The base of the head is defined by generally downwardly facing shoulders 20 on opposite sides of the profile which define longitudinally extending undercut portions of the profile. A neck 22 extending between the valleys 16 and the enlarged head 18 tapers upwardly and inwardly to the shoulders 20 to facilitate secure engagement of the support 10 with the shoulders 20.

The support 10 comprises a clamp 24 which engages the profile 12, a support element 25 and a support post 26 which projects upwardly from the support element in a manner described hereinafter. The support post 26 is shown carrying a pair of barrier mounts 28 each of which has a pair of spaced plates 30 welded to the support post and having aligned apertures therethrough to receive wedge shaped pegs 32. Each of the barrier mounts 28 is shown with a barrier rail 34 locked in place between the spaced plates 30 by means of the peg 32 forcing the barrier rail into engagement with the support post 26. Each barrier mount 28 is preferably capable of locking a barrier rail 34 both transversely to the plane of FIG. 1 as shown and parallel to the plane of the Figure.

The other end of the barrier rails 34 are supported in a second support 10 (not shown) clamped to the decking 14.

In an alternative embodiment, or in addition to the barrier mounts 28, the support post 26 may carry hooks or other devices to support netting or webbing between the spaced posts 26.

The clamp 24 comprises a main jaw 36 and a secondary jaw 38, the jaws 36 and 38 including respective linear legs 40 and 42. The leg 40 of main jaw 36 is colinear and integral with the support element 25 while the leg 42 of secondary jaw 38 is pivoted at 44 from a pair of transverse spaced parallel plates 46 (one only visible in FIG. 1) welded to an upper portion of the leg 40 on respective opposed faces thereof. The spacing of the pivot axis 44 from the leg 40 of main jaw 36 is preferably such that as shown the linear leg 42 of secondary jaw 38 extends parallel to the leg 40 of main jaw 36 when the clamp 24 is secured to the profile 12.

The secondary jaw 38 is pivotable between a pair of transverse spaced plates 48 (one only visible in FIG. 1) welded to opposed faces of the leg 40 of main jaw 36 at a position remote from the plates 46 and pivot axis 44. The plates 48 project substantially beyond the leg 42 when that leg is parallel to the leg 40 and are connected at their remote end by an element 50 having an internally threaded aperture (not shown) therethrough. The plates 48 and element 50 form part of a clamping mechanism to lock the jaws of the clamp 24 onto a profile 12, and a correspondingly threaded shank 52 is received in the aperture of the element 50 and is adjustable by a lever 54 at its remote end to pivotally displace the secondary jaw 38. The shank 52 may be relatively rotatably connected with the secondary jaw 38 in which case rotation of the shank can positively open as well as close the jaws 36 and 38, or the shank may merely abut the secondary jaw 38 to close it, the secondary jaw being free to pivot open when the shank 52 is withdrawn away from it.

At their lower ends remote from the support element 25, the main and secondary jaws 36 and 38 have respective feet 56 as most clearly shown in FIG. 2. As suggested in FIG. 8 to be described hereinafter, the feet 56 extend transversely to either side of the respective jaw and parallel in use to the deck profile 12 so that they bear against a relatively substantial length of the decking 14 to spread the clamping load. Each foot 56 comprises an elongate tubular member 58 of square cross-section welded centrally to the base of the respective leg of the clamping jaws. Each tubular member 58 is secured to the respective leg such that one corner 60 of the square cross-section is lower than the remainder of the section. An elongate V-shaped flange 62 is welded along the tubular member 58 with the inner apex of the flange engaging the bottom corner 60 of the tubular member. The flange 62 associated with either one of the clamping jaws has a leg 64 which projects upwardly and inwardly towards the other clamping jaw. The leg 64 projects beyond the associated tubular member 58 to define an elongate projecting portion 66 which in use engages the respective shoulder 20 of the profile 12 as clearly shown in FIG. 2. When the flanges 62 are clamped in engagement with the shoulders 20 on respective sides of the profile, the flanges may also be in contact with the respective valley 16 of the decking 14 to each side of the profile so that the valleys 16 may take some of the weight of the support 10. However, as shown in FIG. 2 the taper of the neck 22 below the shoulders 20 of the profile ensures that the projecting portion 66 of each flange 62 will ride up the neck to engage the respective shoulder 20 as the clamping jaws are brought together and this may cause the flanges to be lifted off the valleys 16.

It will be noted in FIG. 2 that the diagonal extending from the bottom corner 60 of the tubular member 58 to the opposite corner is not parallel with the longitudinal axes of the respective leg 40 or 42 of the clamp but is inclined upwardly and inwardly towards the opposite jaw so that the flange 62 is tilted somewhat. The preferred inclination is in the range 10° to 45° and as illustrated is about 30°. The reason for this is to approximately equalize the upwards and inwards forces acting on the profile by way of the projecting portion 66 of the flange and to ensure that the projection portion 66 of flange 62 can be received under a relatively low undercut in the profile 12.

The support 10 includes a brace 68 extending away from the support post 26 to alleviate any possibility of the support post 26 and clamp 24 being dislodged from engagement with the respective profile 12 particularly as a result of a horizontal force. The brace 68 comprises a sleeve 70 which is telescopically received over the support element 25 and sits at its lower end on the transverse plates 46 of the clamp 24. The sleeve 70 is welded coaxially to the bottom of the support post 26 and, for additional strength, to the bottom plate 30 of the lower barrier mount 28. The sleeve 70 has an internal cross-section which permits the sleeve to be rotated about the support element 25 whereby the brace 68 may be clamped to a parallel decking profile 12 to that engaged by the clamp 24 or to the same profile, depending upon the principal direction in which it is desired to brace the support post 26. A locking screw 72 with a lever 74 is threadedly received in an aperture (not shown) in the sleeve 70 to engage the support element 25 and lock the brace in the desired direction as well as restrain the support post 26 against being fitted. In an alternative embodiment, if both the support element and sleeve 70 have a corresponding square cross-section, the sleeve may be rotated relative to the support element by first removing the sleeve from the support element, rotating it through, for example, 90° and relocating it on the support element.

An outrigger arm 76 extends substantially horizontally from a bottom portion of the sleeve 70 and is supported by a buttressing arm 78 extending from substantially midway along the outrigger arm to an upper portion of the sleeve 70.

Towards its remote end 80, the outrigger arm slidingly receives a connection bracket 82 which carries a clamp 84 which is identical to the clamp 24 and will accordingly not be described in detail. Insofar as it is described hereinafter, the clamp 84 will use the same reference numerals for the same parts in the clamp 24 but followed by "'". A major difference over the clamp 24 is that the leg 40' of the main jaw 36' of the clamp 84 is not coextensive with a support element but instead terminates at its connection with the transverse pivot plates 46' (only one visible).

A bottom reinforcing plate 86 of the connection bracket 82 is welded to the top edges of the transverse pivot plates 46' and a pair of slide members 88 and 90 are welded to the bottom plate 86 with their slide axes at right angles to each other. The slide members are tubular of square internal cross-section corresponding to the external cross-section of the outrigger arm 76 and, as shown in FIG. 1, the outrigger arm is received in the slide member 88 so that the clamp 84 is capable of engaging a profile 12 parallel to the profile engaged by the clamp 24. If the brace 68 were to engage the same profile 12 as the clamp 24, after releasing the clamp 84 the brace may be rotated about the support element 25 as previously described and the outrigger arm 76 disengaged from the slide member 88 and engaged with the slide member 80. Each of the slide members 88 and 90 has a locking screw 92 screw threadedly engaged therewith which can be tightened onto the outrigger arm when it is received in the respective slide member to secure the outrigger arm therein.

In a modification not shown, the clamp 84 may be pivotably connected with the outrigger arm 76 so that it may engage a profile 12 at any angular position of the outrigger arm 76. This may permit the outrigger arm to extend at, say, 45° to the longitudinal extent of the profiles 12 of the decking 14 when the support 10 is at a corner of the safety barrier. In such an arrangement the clamp 84 would likely be secured to the profile 12 immediately adjacent the profile engaged by the clamp 24.

Figure 3:
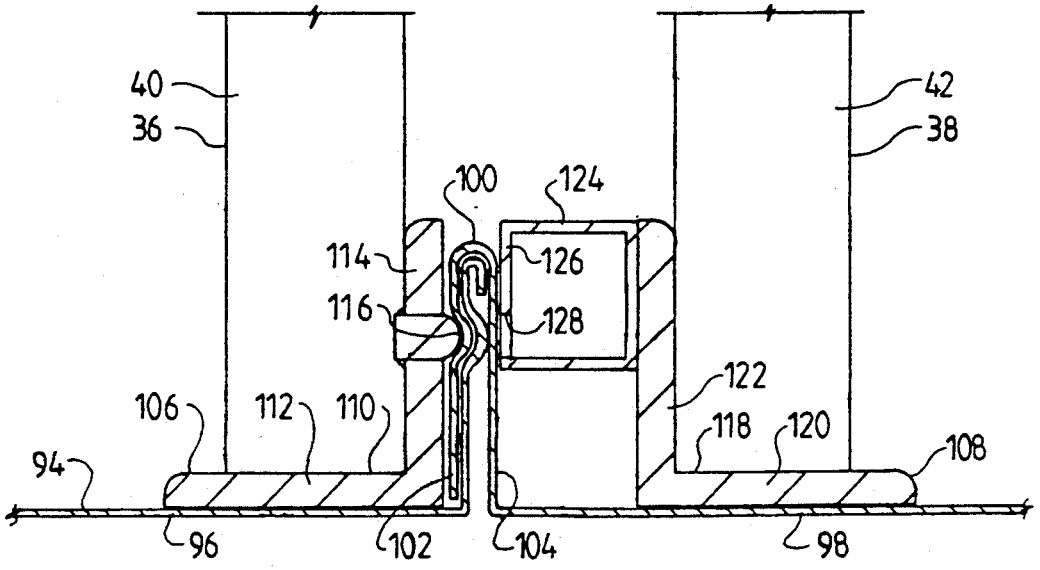
FIG. 3 is a view similar to FIG. 2 but showing modified clamping jaws cooperating with a second deck profile.

In FIG. 3, the decking 94 is defined by adjacent decking sheets 96 and 98 having respective upstanding flanges at their adjacent longitudinal edges which flanges are folded over and crimped to form a raised profile 100 having parallel linear sides 102 and 104 respectively. There is thus no undercut or recess in the profile 100 which can be engaged by the clamping jaws of a support. FIG. 3 illustrates modified feet 106 and 108 of the clamp 24 or 84 of FIG. 1 which are capable of securely engaging the profile 100.

The foot 106 in FIG. 3 is welded to the bottom portion of a leg 40 of clamping jaw 36 and comprises a longitudinally extensive L-shaped flange member 110 extending to respective sides of the leg 40. A first leg 112 of the flange member 110 extends parallel to the plane of the deck and provides a support surface for the clamping jaw 36 on the deck. A second leg 114 extends parallel with the plane of the crimped profile 100 to approximately the same height and has a button 116 welded thereto and projecting outwardly therefrom.

The foot 108 comprises a flange member 118 which corresponds to the flange member 110 and is welded to the bottom of leg 42 of secondary jaw 38 to extend longitudinally on respective sides of the leg 42. Leg 120 of the flange member 118 extends parallel to the deck to provide a support surface while leg 122 extends parallel to the crimped profile 100. A tubular spacing member 124 is welded to the leg 122 and is of similar length to the flange member 118. The spacing member 124 is sized such that when the clamping jaws in FIG. 3 are engaged with the crimped profile 100 the legs 40 and 42 extend substantially parallel to each other. In its outer face 126, the spacing member 124 has an aperture 128 which is opposed to and substantially corresponds in size to the button 116 on flange member 110.

In use, as the clamping jaws 36 and 38 are pivoted towards each other the button 116 and outer face 126 of the spacing member 124 engage respective sides 102 and 104 of the crimped profile 100 and the button 116 deforms the profile by forming a recess in the side 102. With ongoing tightening of the clamping jaws (not shown in FIG. 3) a convex formation is formed in the side 104, which corresponds to the recess in the side 102. Such convex formation at least partially enters the aperture 128 in the outer face 126 of the spacing member 124 whereby both clamping jaws 36 and 38 are securely engaged with the crimped profile 100.

Preferably, a plurality of the buttons 116 is provided on the flange member 110, with a corresponding number of apertures 128 in the spacing member 124. It will be understood that the feet 106 and 108 may be oppositely secured to the clamping jaws 38 and 36 respectively.

Figure 4:
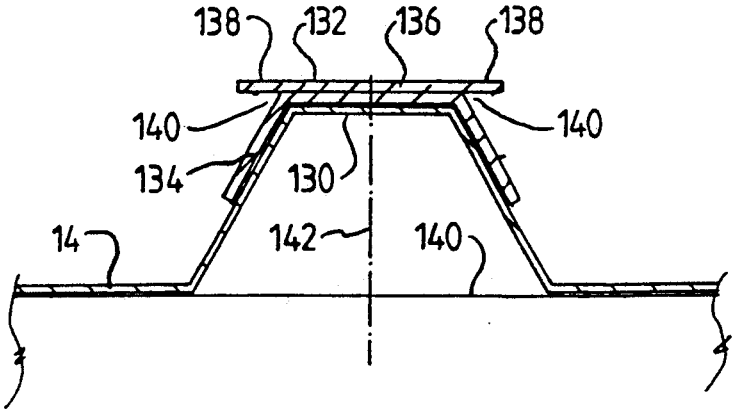
FIG. 4 is a sectional side view of a bracket for fixing to a third roof deck profile.

Referring now to FIG. 4, the deck 14 has a raised profile 130 of frustoconical cross-section which also does not define any recesses or undercuts. In order to permit the support 10 of FIGS. 1 and 2 to be clamped to such a profile, a bracket 132 is fastened to the profile. The bracket 132 comprises an inverted channel member 134 of cross-section corresponding to the profile 130 with a flange 136 welded to the top portion of the inverted channel section 134. The bracket 132 is of such length that it may extend and be secured to two adjacent purlins in the roof structure. Flange 136 extends laterally outwardly on both sides at 138 beyond the channel section 134 to define recesses 140 in which the projecting portion 66 of feet 56 can be received.

The bracket 132 is secured to the profile 130 by standard fastening screws or nails 142 (one shown schematically in chain dotted line) which are normally used to merely secure the decking 14 to a timber or metal purlin 144. Thus, in this case the screw or nail 142 is passed through appropriate apertures (not shown) in the bracket 132, through the top of the profile 130 into the purlin 144. Since the screws or nails are not fastened through the valleys of the decking 14, the risk of leakage is minimised. If the bracket 32 is removed, the same holes in the profile 130 may be used to secure the decking 14 to the purlins.

Figure 5:
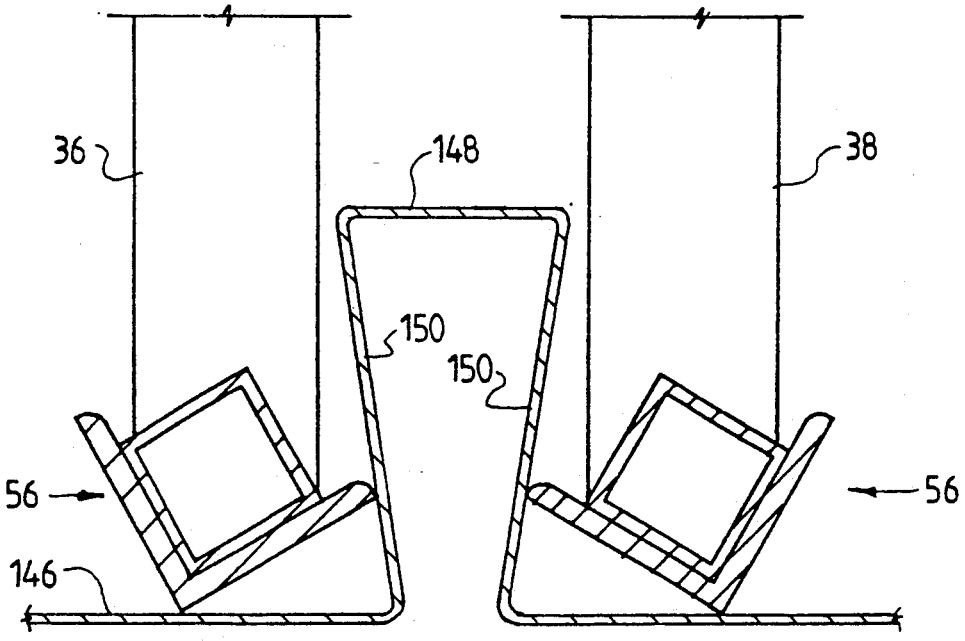
FIG. 5 is a view similar to FIG. 2 but showing the first embodiment of clamping jaws co-operating with one type of floor decking profile.

Referring now to FIG. 5, clamping jaws 36 and 38 with the feet 56 of FIG. 2 are illustrated in use with a further type of deck profile. In this case, the deck 146 is a floor decking on which concrete is to be poured and is known under the trade mark "BONDEK". The decking 146 has an inverted wedge profile 148 which has an undercut surface on each side 150 of the wedge formation. In this embodiment, the undercut side surfaces 150 are inclined such that the feet 56 of the clamping jaws remain in contact with the respective valleys of the deck 146.

Figure 6:
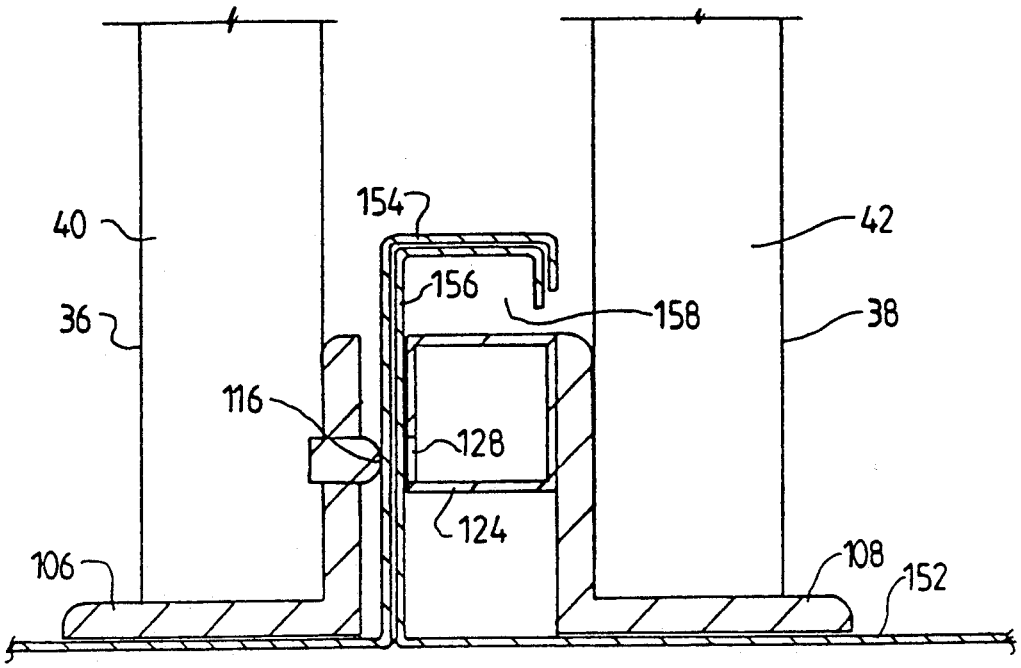
FIG. 6 is a view similar to FIG. 2 with the modified clamping jaws of FIG. 3 co-operating with another type of floor decking profile.

In FIG. 6, a further deck profile is illustrated with which it is appropriate to use the feet 106 and 108 described with reference to FIG. 3. In this embodiment the decking 152 comprises adjacent sheets having upstanding longitudinal extending flanges 154 and 156 respectively at their adjacent edges which are bent over together at their upper ends to define an inverted channel 158. The spacing member 124 of foot 108 is received beneath the inverted channel 158 and this would prevent the clamping jaw 38 being removed without releasing the clamp. However, in addition, as in the embodiment described with reference to FIG. 3, the button 116, on tightening the clamp, forms a recess in the side 154 of the profile which is reflected by a corresponding convex formation (not shown) on the side 156 of the profile which protrudes into the aperture 128 in the spacing member 124. The type of decking 152 illustrated in FIG. 6 is known under the trade mark "CONDECK".

Figure 7:
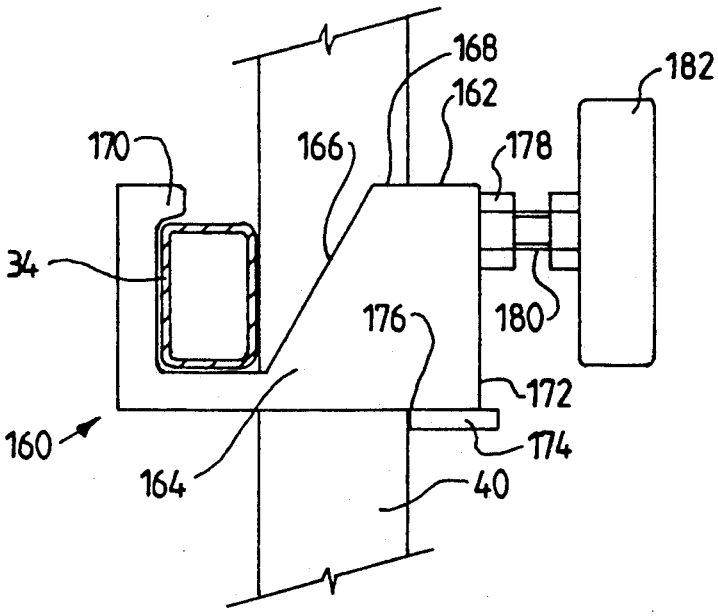
FIG. 7 is a detail of a clamp able to locate a further barrier rail to the support.

FIG. 7 illustrates an additional bracket 160 which may be clamped to, for example, the main jaw leg 40 of the clamp 24 to support a further barrier rail 34 adjacent the deck in order to reduce the risk of articles or personnel sliding beneath the barrier.

The bracket 160 comprises a U-shaped fitting 162 which extends with respective legs 164 (one only shown) on opposite sides of the leg 40. The legs 164 of the element 162 have aligned cutouts 166 therein which are open at an upper edge 168. Each leg 164 defines a lip 170 at its remote end which projects into the cutout 166 to prevent upwards withdrawal of the barrier rail 34 when the barrier rail is secured.

At its base 172 the element 162 has a plate 174 welded to the bottom edge to define a fulcrum point 176 about which the bracket pivots as the bracket 160 is tightened to lock the barrier rail 34 in place. In order to enable this tightening to be effected, the base 172 has a screw threaded nut 178 welded thereto in alignment with an aperture (not shown) through an upper portion of the base. A screw threaded shaft 180 is threadedly engaged with the nut and projects through the aperture in the base to abut the leg 40. Rotation of the shaft 180 is by means of the lever 182.

Figure 8:
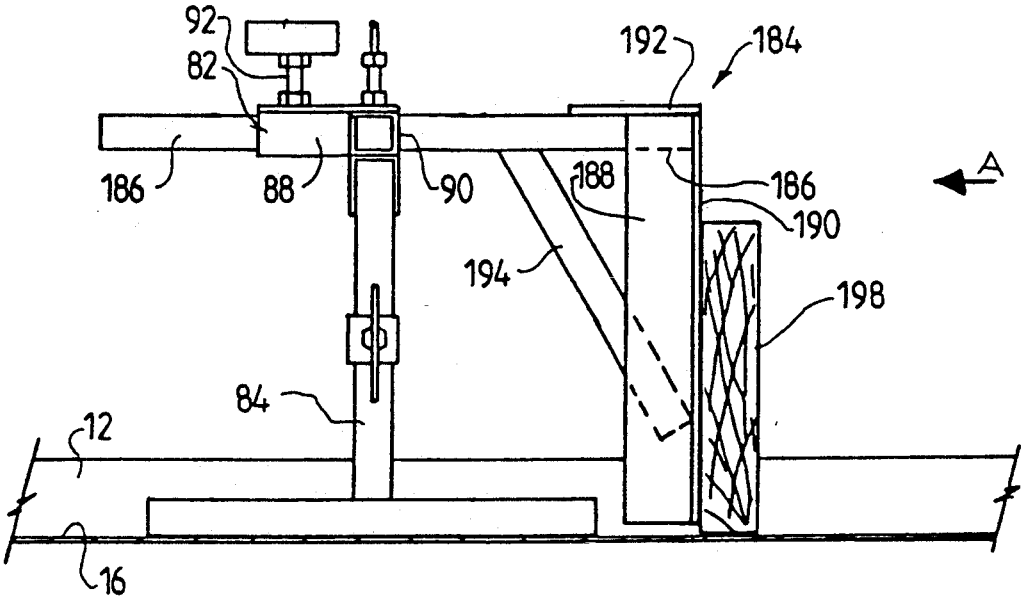
FIG. 8 is a side elevational view of a formwork assembly incorporating a support according to the invention.
Figure 9:
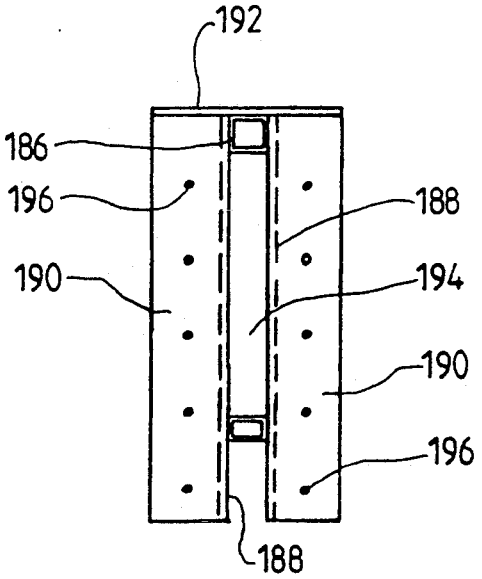
FIG. 9 is a front view of the formwork locator looking in the direction of arrow "A" in FIG. 8 with the formwork board removed.

Referring now to FIG. 8, a clamp 84 including a connection bracket 82 is associated with a formwork locator 184. The clamp 84 and connection bracket 82 are identical to the corresponding parts described with reference to FIG. 1 and will accordingly not be described further. However, it will appreciated that the clamp 84 may be modified, for example, as described with reference to FIG. 3 depending upon the shape of the raised profile of the deck. The formwork locator 184 is provided to temporarily define the edge of a partial concrete pour over the decking 16. The formwork locator 184 comprises a connecting arm 186 which is slidingly received in the appropriate slide member 88 or 90 and locked in place by the corresponding clamping screw 92. A pair of angle members 188 are welded to respective sides of the remote end of the connecting arm 186 and depend therefrom with the planar front legs 190 of the angle members aligned. A reinforcing plate 192 is welded to the top of the angle members and to the top of the end portion of the connecting arm. With the angle members 188 spaced to either side of the connecting arm 186, an inclined bracing member 194 extends from between them up to the connecting arm, the bracing member being welded to the angle members and to the connecting arm. The front legs 190 of the angle members 188 have a series of holes 196 therethrough whereby a formwork board 198 extending between two such formwork locators 184 can be nailed to the angle members. Adjustment of the formwork locator may be by slidably adjusting the connecting arm 186 in the respective slide member 88 or 90 or by releasing the clamp 84 and displacing that along the associated profile.

Figure 10:
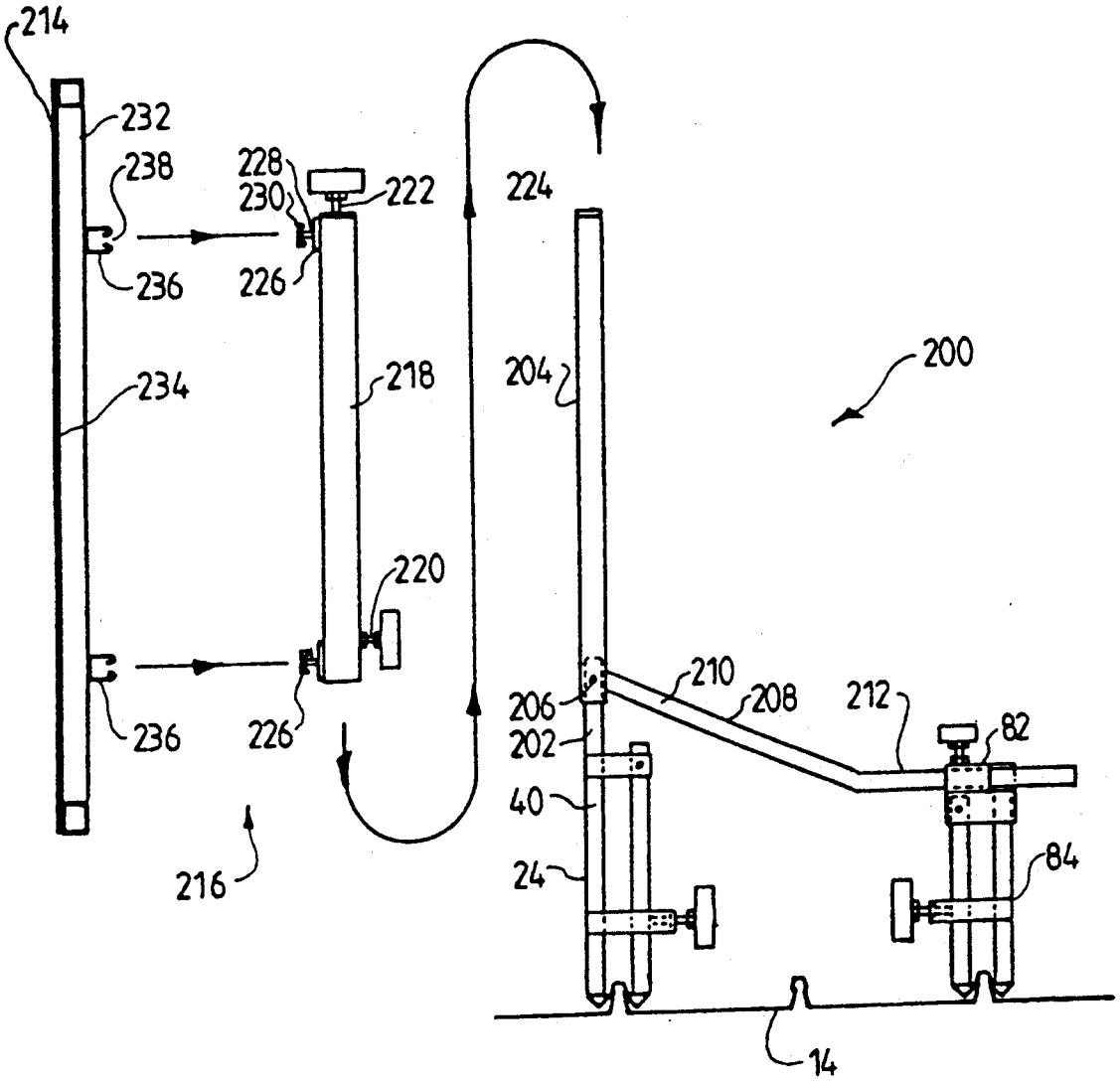
FIG. 10 is an exploded side elevational view of a display assembly including a second embodiment of the support.

Referring now to FIG. 10, the support 200 is similar to the support 10 of FIGS. 1 and 2 and will be described only insofar as it differs to the support 10. The clamps 24 and 84 in FIG. 10 are identical to those in FIG. 1, but in the support 200 a support post 204 is telescopically received on a support element 202 and is locked in place by a removable pin 206. An outrigger arm 208 extends from the bottom portion of-the support post 204 and differs from the outrigger arm 76 essentially in that the portion of the outrigger arm 76 between the inclined buttress 78 and the sleeve 70 is omitted. Thus, the outrigger arm 208 comprises an outwardly and downwardly inclined portion 210 merging with a remote horizontal portion 212 on which the clamp 84 is lockingly received. If it is necessary for the brace comprising the outrigger arm 208 and clamp 84 to engage the same profile as the clamp 24, the pin 206 may be released from the support element 202 to enable the support post 204 to be lifted from the support element with the brace, and rotated through 90° before being relocated on the support element.

FIG. 10 illustrates in exploded manner how the support 200 can mount a display sign 214. A display sign assembly 216 comprising the display sign 214 includes a mounting sleeve 218 which is telescopically receivable over the support post 204. The mounting sleeve 218 is sized to be rotatable on the support post 204 and can be locked at the desired angular position by means of a clamping screw 220 which is threadedly engaged with the sleeve 218 and locks onto the support post 204. At its upper end the mounting sleeve 218 has a locking screw 222 threadedly engaged therewith along the axis of the sleeve which can engage a threaded plate 224 in the upper end of the support post 204 to lock the mounting sleeve onto the support post.

The mounting sleeve 218 is provided with axially spaced mounting brackets 226 which comprise a shank 228 projecting outwardly from the mounting sleeve and an enlarged head 230 at the outer end of the shank.

The display sign 214 comprises a rectangular frame 232 of square cross-section (one upright leg of the frame has been omitted for clarity) to which the sign 234 to be displayed is affixed. A pair of horizontal mounting channels 236 extend across the back of the frame 232 and are shaped to slidingly receive the mounting brackets 226 therein. Thus, each mounting channel has a longitudinally extending slot 238 in its face remote from the frame 232 through which the shank 228 of the mounting bracket 226 can extend. Adjacent slot 238, the edges of the mounting channel are turned inwardly to provide a channel section which generally corresponds to the shape of the head 230 of the bracket 226.

Generally, the display sign 214 would be engaged with two mounting sleeves 218 each with its associated support 200 clamped on the roof profile.

The invention has been described by way of example only and modifications are possible within the scope of the invention. In particular, it will be appreciated that the described supports may be used for different purposes than the safety barrier, formwork locator and display assembly described.

We claim:

1. A support for a structure adapted to be carried by a deck of a building during or after completion of fabrication of the building, such structure comprising a plurality of the supports, the support comprising a support element which is clampable to the deck and to which the structure may be mounted and bracing means for the support element which is clampable to the deck at a position remote from the support element, each of the support element and bracing means being clampable to the deck by respective clamping means comprising a pair of clamping jaws relatively movable towards each other by a clamping mechanism, each pair of clamping jaws comprising opposed longitudinally extensive feet respectively relatively movable with the jaws and adapted to engage along the length of each foot a respective side of a raised profile of the deck, at least one of the feet of each clamping means defining at least one projecting portion which projects towards the other jaw of said clamping means and which is capable of engaging a recess or undercut in the raised profile of the deck or in a fitting secured over the deck profile so that operation of the clamping mechanism causes the clamping jaws to securely clamp the support element and bracing means to the deck and hold the support element against displacement.

2. A support according to claim 1 wherein the clamping jaws of the support element clamping means are pivoted at a position remote from the respective feet.

3. A support according to claim 1 wherein the clamping jaws of the support element clamping means comprise a pair of substantially straight legs each having the associated foot at one end, said legs being substantially parallel when the clamping jaws are securely clamped to the deck.

4. A support according to claim 1 wherein the clamping mechanism of the support element clamping means comprises a screw mechanism extending between the clamping jaws and having a screw threaded shaft which is adjustable to relatively displace the clamping jaws towards each other.

5. A support according to claim 1 wherein the clamping mechanism of the support element clamping means comprises a camming mechanism.

6. A support according to claim 1 wherein each foot of the clamping means for the support element has at least one projecting portion, each said projecting portion being arranged such that it is inclined upwardly towards a remote end when the clamping jaws are securely clamped to the deck.

7. A support according to claim 6 wherein each projecting portion comprises an elongate flange adapted to extend along the raised profile or fitting of the deck.

8. A support according to claim 1 wherein the at least one projecting portion is defined on one of the feet of the clamping means for the support element and an opposed aperture is provided in the other foot of said clamping means.

9. A support according to claim 1 wherein the clamping means for the bracing means is substantially identical to the clamping means for the support element.

10. A support according to claim 1 wherein the bracing means comprises an outrigger arm and the associated clamping means depends from the outrigger arm.

11. A support according to claim 10 wherein the clamping jaws of the clamping means for the bracing means are elongate and extend substantially perpendicularly to the associated feet.

12. A support according to claim 11 wherein a portion of the outrigger arm from which the associated clamping means depends extends substantially perpendicularly to the elongate clamping jaws.

13. A support according to claim 10 wherein the clamping means of the bracing means is slidably received on the outrigger arm and locking means is provided to selectively secure the clamping means against said sliding movement.

14. (amended) A support according to claim 13 wherein the associated clamping means carries a pair of slide members each capable of being received on the outrigger arm, said slide members having slide axes at right angles to each other.

15. (amended) A support according to claim 1 wherein the bracing means is buttressed relative to the support element.

16. (amended) A support according to claim 1 wherein the bracing means is telescopically mounted on the support element and is selectively rotatable relative thereto.

17. A support according to claim 1 including an upright support post which is integral with or extends from the support element.

18. A structure comprising a display assembly having a plurality of deck-mountable supports each said support being in accordance with claim 17.

19. A structure comprising a safety barrier having a plurality of deck-mountable supports each said support being in accordance with claim 17.

20. A structure according to claim 19 wherein for each support the feed of each damping means are in engagement with the deck at respective sides of the raised profile of the deck, the at least one projecting portion is engaged with the recess or undercut in the raised profile or in the fitting secured over the deck profile whereby the clamping jaws are securely clamped to the deck.

21. In combination, a roof decking and a support mounted on the said roof decking, said roof decking having a plurality of raised, longitudinally extending profiles, each said profile having opposed recesses along its length for receiving a clamping mechanism which is part of said support, said clamping mechanism comprising a pair of longitudinally extending members which are pivotable with respect to each other at one end of said longitudinally extending members, the other end of said longitudinally extending members having clamping feet, each of said clamping feet having a projecting elongate flange which projects toward the other of the said clamping feet, a screw threaded mechanism mounted on said longitudinally extending members between the said feet and the said one end of said longitudinally extending members, the screw threaded mechanism being capable of pivoting the longitudinally extending members towards each other so that the projecting flange of one of said clamping feet engages one of the said opposed recesses of the said raised profiles of the said roof decking and so that the projecting flange of the other of said clamping feet engages the other of the said opposed recesses of the said raised profiles of the said roof decking.

22. A support capable of being mounted on a roof decking which has a plurality of raised, longitudinally extending profiles having opposed recesses along their length, said support including a clamping mechanism comprising a pair of longitudinally extending members which are pivotable with respect to ech other at one end of said longitudinally extending members, the other end of said longitudinally extending members having clamping feet, each of said clamping feet having a projecting elongate flange which projects toward the other of the said clamping feet, a screw threaded mechanism mounted on said longitudinally extending members between the said feet and the said one end of said longitudinally extending members, the screw threaded mechanism being capable of pivoting the longitudinally extending members towards each other so that the projecting flange of one of said clamping feet is capable of engaging one of the opposed recesses of a raised profile of the roof decking and the projecting flange of the other of said clamping feet being capable of engaging the other of the opposed recesses of the same raised profile of the roof decking.

* * * * *

UNITED STATES PATENT AND TRADEMARK OFFICE

CERTIFICATE OF CORRECTION

PATENT NO. : 5,249,769

DATED : October 5, 1993

INVENTOR(S) : Cornelis J. Griek et al.

It is certified that error appears in the above-identified patent and that said Letters Patent is hereby corrected as shown below:

On the Title Page, change the first inventor's given name from "Cornelius" to --Cornelis--.

Column 3, line 60, change "projection" to --projecting--.

Column 6, line 44, before "safety" insert --a--.

Column 7, line 25, change "one only" to --only one--.

Column 7, line 33, change "one only" to --only one--.

Column 8, line 28, change "projection" to --projecting--.

Column 11, line 15, change "one only" to --only one--.

Column 13, line 66 delete "(amended)".

Column 14, line 3, delete "(amended)".

Column 14, line 6, delete "(amended)".

Column 14, line 13, after "supports" insert --,--.

Column 14, line 16, after "supports" insert --,--.

UNITED STATES PATENT AND TRADEMARK OFFICE

CERTIFICATE OF CORRECTION

PATENT NO. : 5,249,769

DATED : October 5, 1993

INVENTOR(S) : Cornelis J. Griek et al.

It is certified that error appears in the above-identified patent and that said Letters Patent is hereby corrected as shown below:

Column 14, line 19, change "feed" to --feet--, change "damping" to --clamping--.

Column 14, line 52, change "ech" to --each--.

Signed and Sealed this

Twenty-first Day of June, 1994

Bruce Lehman

*Attest:*

BRUCE LEHMAN

*Attesting Officer*

*Commissioner of Patents and Trademarks*